US008414184B2

(12) United States Patent
Mallet et al.

(10) Patent No.: US 8,414,184 B2
(45) Date of Patent: Apr. 9, 2013

(54) BALANCE WITH INERTIA ADJUSTMENT WITH NO INSERTS

(75) Inventors: Daniel Mallet, Le Luhier (FR); Frédéric Tolle, Les Fins (FR); Philippe Barthoulot, Maiche (FR); Daniel Vicente, Colombier (CH); Emmanuel Graf, Le Locle (CH); Philomène Berger, Provence (CH); Pierre Cusin, Villars-Burquin (CH)

(73) Assignee: Nivarox-FAR, Le Locel (CH)

( * ) Notice: Subject to any disclaimer, the term of this patent is extended or adjusted under 35 U.S.C. 154(b) by 79 days.

(21) Appl. No.: 13/184,903

(22) Filed: Jul. 18, 2011

(65) Prior Publication Data

US 2012/0014229 A1 Jan. 19, 2012

(30) Foreign Application Priority Data

Jul. 19, 2010 (EP) ..... 10170007

(51) Int. Cl.
*G04B 17/20* (2006.01)

(52) U.S. Cl. ..... 368/170; 368/127; 368/169

(58) Field of Classification Search ..... 368/127, 368/168–178

See application file for complete search history.

(56) References Cited

U.S. PATENT DOCUMENTS

| | | | | |
|---|---|---|---|---|
| 12,129 | A * | 1/1855 | Hawkes et al. | 368/171 |
| 131,782 | A * | 10/1872 | Randall | 74/571.11 |
| 322,093 | A * | 7/1885 | Davies | 368/169 |
| 965,505 | A * | 7/1910 | Dubois | 368/171 |
| 1,859,866 | A * | 5/1932 | Dubois | 368/171 |
| 2003/0179655 | A1* | 9/2003 | Scheufele | 368/127 |
| 2007/0140065 | A1* | 6/2007 | Levingston | 368/127 |

FOREIGN PATENT DOCUMENTS

| | | |
|---|---|---|
| CH | 471 410 | 12/1968 |
| EP | 1 562 087 A1 | 8/2005 |
| EP | 2 104 008 A1 | 9/2009 |
| FR | 998 791 | 1/1952 |
| FR | 1 275 357 | 11/1961 |
| FR | 1 301 938 | 8/1962 |

OTHER PUBLICATIONS

European Search Report issued Jan. 25, 2011, in European Application No. 10170007, filed Jul. 19, 2010 (with English Translation).

* cited by examiner

*Primary Examiner* — Sean Kayes
(74) *Attorney, Agent, or Firm* — Oblon, Spivak, McClelland, Maier & Neustadt, L.L.P.

(57) ABSTRACT

The invention concerns a timepiece balance (1), with inertia adjustment including a hub (2) pivoting about a balance staff (3) and a felloe (5), connected to said hub (2) by a joining surface (6).

It is wherein said felloe (5) is made in a single piece with said joining surface (6) and said hub (2) in a micro-machinable material, or silicon, or quartz, or a compound thereof, or an alloy derived from MEMS technology, or an alloy obtained by the "LIGA" method, and in that it includes at least a first resilient arm (40) including coupling means (41) arranged for cooperating, in various coupling positions, with complementary coupling means (42) comprised in said felloe (5) to form, in the coupling position, a closed loop, the inertia of which relative to said balance staff (3) is variable according to said coupling positions.

The invention also concerns a sprung balance or a timepiece incorporating a balance of this type.

15 Claims, 2 Drawing Sheets

BALANCE WITH INERTIA ADJUSTMENT WITH NO INSERTS

This application claims priority from European Patent Application No. 10170007.8 filed 19 Jul. 2010, the entire disclosure of which is incorporated herein by reference.

FIELD OF THE INVENTION

The invention concerns a timepiece balance with inertia adjustment for adjusting the inertia and/or poising and/or oscillation frequency thereof, including a hub arranged for cooperating with an arbour pivoting about a balance staff perpendicular to a balance plane, and a continuous or discontinuous peripheral felloe, connected to said hub by at least one joining surface.

The invention also concerns a sprung balance incorporating a balance of this type.

The invention also concerns a timepiece incorporating this type of sprung balance or balance.

The invention concerns the field of regulating members for timepieces and more specifically the balance or sprung balance.

BACKGROUND OF THE INVENTION

The precision of a caliber depends upon the quality of its regulating member, and very high oscillation frequencies, for example of 10 Hz, compared to the usual frequencies of 2.5 to 4 Hz, are only obtainable if suitable regulating members are conceived, in particular as regards the balance.

Indeed, the energy to be provided for maintaining oscillation, in the form of elastic balance spring torque, is proportional to the product, on the one hand, of the inertia of the balance about the pivoting axis, and, on the other hand, of the square of the frequency. Thus, for example, for the same energy, a frequency change from 4 Hz to 10 Hz results in the inertia being divided by approximately 6. For a frequency of 4 Hz, balance inertia of 12 $mg \cdot cm^2$ is considered to be good, since this type of balance conventionally has a diameter of 9 to 10 mm. Thus, a balance for use at 10 Hz must have a low inertia value, in particular less than 2 $mg \cdot cm^2$.

For optimum operation, a balance for use at 10 Hz must also have minimal mass, notably less than 30 mg, so as to reduce friction in the bearings, to avoid isochronism disturbance in the various positions of use.

Although it has low mass and inertia, the balance of a high frequency oscillator must also allow adjustment of the unbalance and perfect poising, both static and dynamic, and the construction thereof must make setting and/or adjustment operations possible. It is not therefore possible to use conventional technology, or solutions with lighter balances such as the balances wherein the felloe has spokes disclosed in FR Patent No. 1275 357 in the name of Straumann, or FR Patent No. 1 301 938 in the name of LIP. Indeed, even the reduced mass of these balances does not provide sufficiently low inertia. Likewise, the mass and inertia of a titanium balance in accordance with EP Patent No. 1 562 087, in the name of MONTRES BREGUET SA and devised with a titanium felloe and arms and reduced sections, are still greater than required for optimum operation.

FR Patent No. 998 791 A in the name of JAEGER ETS discloses a balance with adjustable inertia, including flexible felloe arms which can be screwed into a particular position. EP Patent No. 2 104 008 A1 in the name of NIVAROX SA discloses a single-piece silicon sprung balance unit. CH Patent No. 471 410 A in the name of LANGENDORF WATCH CO also discloses a balance with a flexible felloe that can be adjusted using screws.

A Q factor on the order of 500 is also sought, thus considerably higher than that of conventional oscillators where, for good quality watches, the Q factor is close to 220 to 280. This Q factor can only be obtained by combining a silicon or similar balance spring with a balance that satisfies the above conditions. In addition to obtaining a high Q factor, combined with setting and adjustment possibilities, the index-assembly must also be omitted.

Moreover, since the mass of the unit is limited, the smallest possible number of components should be preferred.

However, micro-machinable materials, such as silicon and quartz, which are theoretically made in finite dimensions, with very precise tolerances, are not easy to machine subsequently.

It is therefore necessary, for regulating members made of such materials or incorporating at least one component made of this type of material, to have the possibility of frequency and/or inertia adjustments, but by avoiding machining and by prioritising setting possibilities.

SUMMARY OF THE INVENTION

The inventive step consists in creating the conditions for a balance structure, including the hub, felloe, and connections between these two components, which is as light as possible, moving as far as possible from the hub any masses of density higher than said structure, and incorporating in said structure regulating means for performing settings and adjustments without reverting to machining.

The invention therefore concerns a timepiece balance, with adjustable inertia for adjusting the inertia and/or poising and/or oscillation frequency thereof, including a hub arranged for cooperating with an arbour pivoting about a balance staff perpendicular to a balance plane, and a continuous or discontinuous peripheral felloe, connected to said hub by at least one joining surface, characterized in that said felloe is made in a single piece with said joining surface and said hub is made of a micro-machinable material, or silicon, or quartz or a compound thereof, or an alloy derived from MEMS technology, or an alloy obtained by the "LIGA" process, and in that said felloe includes at least a first resilient arm including coupling means arranged for cooperating, in various coupling positions, with complementary coupling means comprised in said felloe in order to form, in a coupling position, a closed loop, the inertia of which, relative to said balance staff, is variable according to said coupling positions.

The invention further concerns a sprung balance incorporating at least one such balance.

The invention also concerns a timepiece incorporating at least one such sprung balance or at least one such balance.

With the preferred use of silicon a balance structure is obtained which is both very light and very rigid, and which may be honeycombed in the area of the joint between the hub and the felloe. Transferring inserts, which may be provided with screws, to the periphery contributes to obtaining properly dimensioned inertia despite the very low total mass of the balance. The adjustment and poising functions are guaranteed and facilitated.

This type of balance is perfectly suitable for good operation at a frequency of 10 Hz and at frequencies higher than 10 Hz.

BRIEF DESCRIPTION OF THE DRAWINGS

Other features and advantages of the invention will appear upon reading the following description, with reference to the annexed Figures, in which.

DETAILED DESCRIPTION OF PREFERRED EMBODIMENTS

The invention concerns the field of regulating members for timepieces and more specifically the balance or sprung balance.

The invention is more specifically directed towards the production of balances for high oscillation frequencies, of 10 Hz or higher.

Alternative embodiments, which are in no way limiting, are shown in the Figures.

The invention concerns the realization of a timepiece balance 1 with inertia adjustment for adjusting the inertia and/or poising and/or oscillation frequency thereof.

Figure 3:
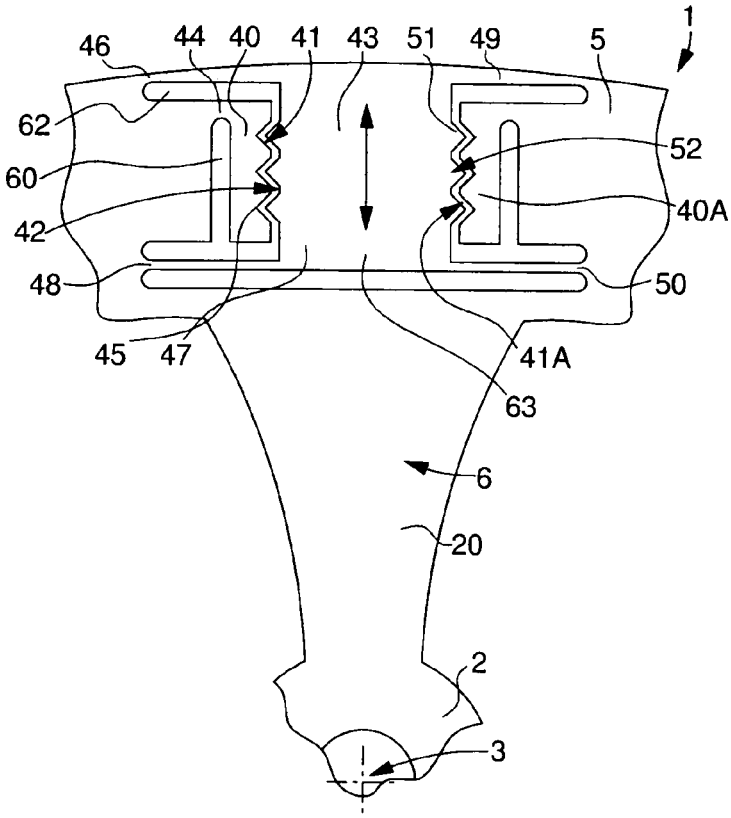
FIG. 3 shows schematically and in a section perpendicular to the balance staff and parallel to the balance plane, a third variant of the invention.

This balance 1 includes a hub 2 arranged for cooperating with an arbour pivoting about a balance staff 3 perpendicular to a balance plane 4 and a peripheral, continuous or discontinuous felloe 5. This felloe 5 may in fact be discontinuous for the purpose of making the balance lighter. A continuous felloe 5, as shown in FIG. 3, offers the advantage of good rigidity and good aero-dynamism, and limits any local bending by preventing balance 1 from warping.

This felloe 5 is connected to hub 2 by at least one joining surface 6, which may be formed of a continuous surface such as a pierced or non-pierced disc, or by several arms 20. Making a pierced joining surface 6, notably with cut out portions, which may or may not be through cuts, between lateral members providing good triangulation, further reduces the mass of the balance.

Preferably according to the invention, in all of the variants of all of the embodiments described below, in order to obtain a balance with a high performance at an oscillation frequency of 10 Hz or higher, felloe 5 is made in a single piece with joining surface 6 and hub 2 in a micro-machinable material, or silicon, or quartz, or a compound thereof, or an alloy derived from MEMS technology, or an alloy obtained from the "LIGA" process.

The selection of silicon gives particularly good results and is the preferred solution.

According to the invention, felloe 5 includes at least a first resilient arm 40. This resilient arm 40 includes coupling means 41, which is arranged for cooperating, in various coupling positions, with complementary coupling means 42 comprised in felloe 5, to form, in a coupling position, a closed loop, the inertia of which, relative to balance staff 3, is variable according to said coupling positions.

Coupling means 41 and complementary coupling means 42 may be made with any type of mutually complementary profiles including a periodic pitch, so as to allow coupling with each other in a plurality of different positions.

It is clear that deforming the geometry of felloe 5 causes a variation in the inertia of balance 1.

A significant advantage of the invention is that this inertia variation is reproducible, and can very easily be memorized, given that coupling means 41 and complementary coupling means 42 occupy discrete positions, which can very easily be memorized to recreate a particular setting.

Figure 1:
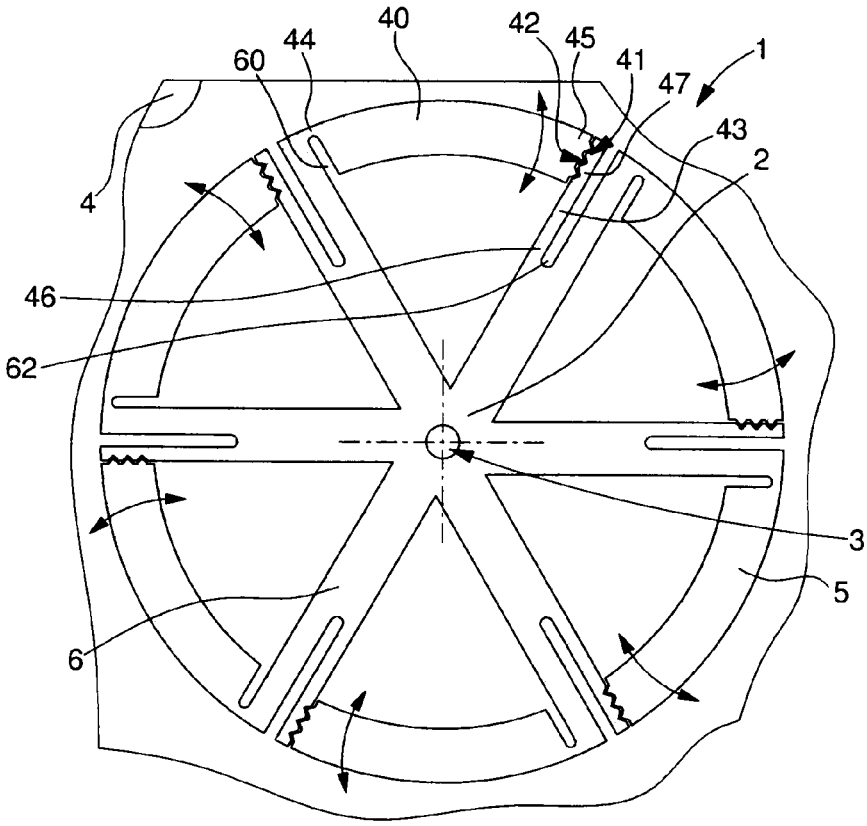
FIG. 1 shows schematically and in a section perpendicular to the balance staff and parallel to the balance plane, a first balance variant according to the invention.
Figure 2:
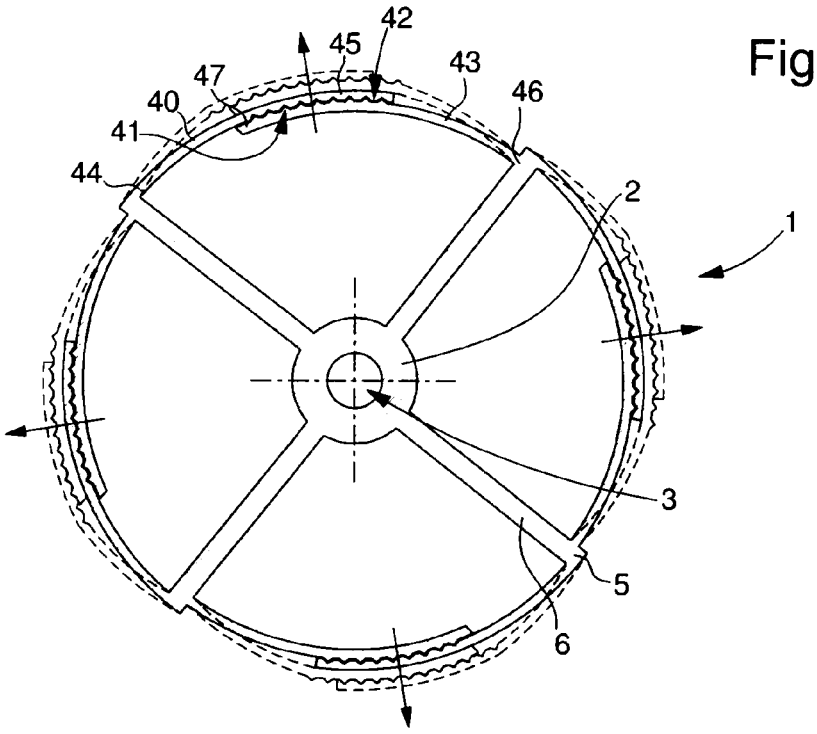
FIG. 2 shows schematically and in a section perpendicular to the balance staff and parallel to the balance plane, a second variant of the invention.

Preferably, the periphery of felloe 5 includes, as visible in FIGS. 1 and 2, several of these resilient arms 40. The peripheral arrangement of the arms, substantially tangential to felloe 5, enables significant length to be attributed thereto, resulting in considerable deviation for a minimum angle of deformation.

In a preferred embodiment, seen in FIGS. 1 to 3, the first resilient arm 40 includes a resilient connection with felloe 5 at least at a first end 44. This resilient connection can be achieved by the presence of a slot 60 in the felloe, as in FIGS. 1 and 3, or more simply, as in FIG. 2, by a reduced section of felloe 5, by using the elastic properties of the material of felloe 5, notably silicon. The first resilient arm 40 preferably includes coupling means 41 at a second end 45 thereof, opposite first end 44.

Figure 4:
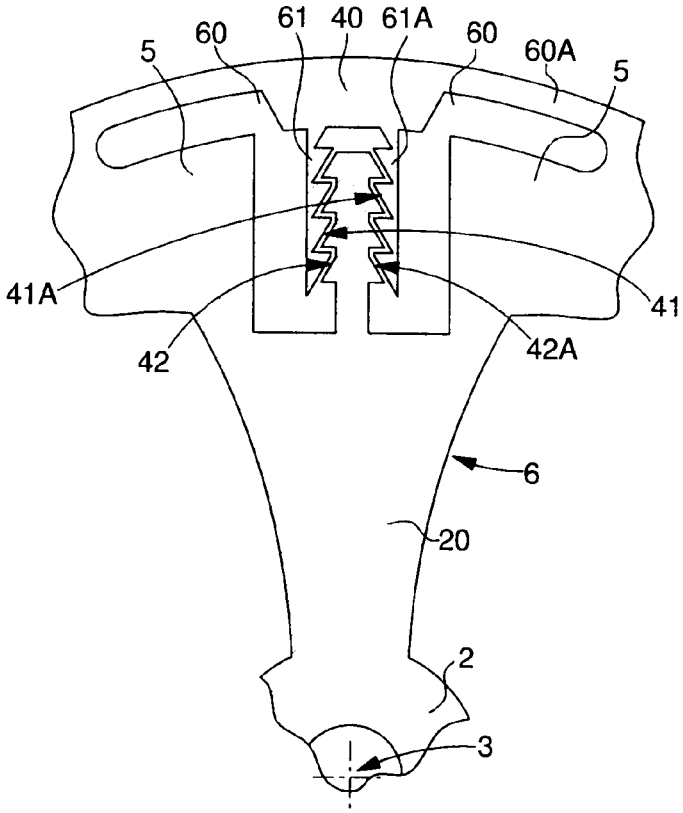
FIG. 4 shows schematically and in a section perpendicular to the balance staff and parallel to the balance plane, a fourth variant of the invention.

This embodiment of first resilient arm 40 is not exclusive, as seen in FIG. 4, where the resilient arm 40 can move by deformation between two slots 60 and 60A comprised in felloe 5. In this fourth variant, resilient arm 40 carries a first projecting portion 61 holding coupling means 41, which cooperates, in various coupling positions, with complementary coupling means 42 of felloe 5. It also holds a second projecting portion 61A holding coupling means 41A, which cooperates, in different coupling positions, with complementary coupling means 42A of felloe 5.

In a preferred embodiment, seen in FIGS. 1 to 3, this complementary coupling means 42 is arranged on a second resilient arm 43 comprised in felloe 5. In a preferred embodiment, seen in FIGS. 1 to 3, the second resilient arm 43 includes a resilient connection with felloe 5, at least at a first end 46. This resilient connection may be achieved by the presence of a slot 62 in the felloe, as in FIGS. 1 and 3, or more simply, as in FIG. 2, by a reduced section of the felloe 5, by using the elastic properties of the material of felloe 5, particularly silicon. The second resilient arm 43 preferably includes the complementary coupling means 42 at a second end 47 thereof, opposite first end 46.

In a particular embodiment, seen in FIG. 3, this second resilient arm 43 also includes, at a third end 48, at a distance from first end 46 and second end 47, at least one resilient connection with felloe 5.

Preferably, in this third variant of FIG. 3, the second resilient arm 43 further includes, at a fourth end 49, at a distance from first end 46 and second end 47, at least one resilient connection with felloe 5. The second resilient arm 43 further includes, at a fifth end 50, at a distance from first end 46 and second end 47, at least one resilient connection with felloe 5. The second resilient arm 43 further includes, at a sixth end 51, other complementary coupling means 52 arranged for cooperating with coupling means 41A comprised in another first resilient arm 40A, different from the arm with which complementary means 42 cooperates.

In short, in this third variant of FIG. 3, a suspended mass 63 is created, which is mobile inside felloe 5 in this particular and non-limiting case, between four resilient lips. Coupling means 41 and complementary coupling means 42 are enclosed in felloe 5. This suspended mass 63 carries the complementary coupling means 42 and complementary coupling means 52, which respectively cooperate with the coupling means 41 of a resilient arm 40 and with the coupling means 41A of another first resilient arm 40A. This embodiment provides a simple adjustment, similar to a push-button integrated in felloe 5. This solution is also particularly rigid.

The fourth variant of FIG. 4, described above, shows a close version wherein coupling means 41 and complementary coupling means 42 are totally integrated in felloe 5, but are not mobile.

In one embodiment, as seen in FIGS. 1, 3 and 4, coupling means 41 and complementary coupling means 42 are mobile relative to each other in a radial direction with respect to balance staff 3. The radial mobility of the coupling means in relation to each other results in a radial shift in the centre of inertia of the portion of felloe 5 in which said means are incorporated.

In another embodiment, seen in FIG. 2, coupling means 41 and complementary coupling means 42 are mobile relative to each other in a tangential direction with respect to felloe 5. Two different coupling positions are shown in FIG. 2, one in full lines, the other in dotted lines. The difference in shape, and thus inertia, in the loop formed by the connection of the first resilient arm 40 with the second resilient arm 43 is clearly shown. The tangential mobility of these two resilient arms relative to each other results in a radial shift of the centre of inertia of said two arms. Adoption of a symmetrical execution of the arms relative to balance staff 3, and performing the same inertia adjustments symmetrically relative to said staff, allows the total inertia of balance 1 to be altered, without altering the main axis of inertia thereof, which must merge with balance staff 3. Of course, a differential adjustment remains possible, but is only advantageous if additional masses are added to balance 1.

Preferably, as seen in FIGS. 1 to 4, coupling means 41 and complementary coupling means 42 are formed by antagonistic toothed sectors.

In a preferred embodiment, these toothed sectors each include an inclined toothing so as to remain meshed with each other in the absence of any unmeshing action.

Naturally, coupling means 41 and complementary coupling means 42 may be made with any type of mutually complementary profiles and including a periodic pitch, to permit coupling with each other in a plurality of different positions. For example, these profiles may also be formed of straight notches or suchlike.

As shown in these different variants, the invention offers the possibility of using a single-piece balance 1 with no inserts, which reduces the number of components. Sufficient inertia is obtained by the appropriate dimensioning of felloe 5. In the event of requirement for an even higher inertia, it is also possible, without departing from the scope of the invention, to permanently and irremovably secure additional masses with known and preferably imposed inertia, made of heavy metals or gold or suchlike, in precise positions at the periphery of felloe 5. For example, these additional masses may be secured, in the form of rivets or suchlike, to the suspended mass 63 of FIG. 3, or in areas of felloe 5 having a large section, for example at the join with joining surface 6 or with arms 20.

The complex looking geometry of the different variants of the balances set out above is only possible if said balances are made of micro-machinable materials or preferably silicon, since the methods implemented very easily allow such contours to be achieved, with very high dimensional precision, and make it possible to realise resilient strips, and thus use the elastic properties of the material, notably silicon.

The invention therefore enables a balance 1 to be formed which can oscillate at a high frequency, notably higher than or equal to 10 Hz, and allow fine setting or adjustment operations, which are, moreover, reversible and reproducible.

The invention further concerns a sprung balance incorporating at least one such balance 1, according to any of the embodiments and any of the variants set out above.

The invention also concerns a timepiece incorporating at least one such sprung balance, or at least one such balance 1.

The use of silicon allows considerably greater diameter dimensioning than could be achieved with a balance of conventional construction with similar inertia. The high level of elasticity of silicon is particularly advantageous for making the resilient arms of the invention.

The choice of silicon, in particular, allows elastic holding means to be made in the felloe, notably in the form of elastic lips. Likewise, stop means in the form of clicks may be combined with such strips or with springs made in the silicon felloe.

This choice of silicon or an alloy derived from MEMS technology or an alloy obtained by the "LIGA" process ensures a very precise geometry for felloe 5, because of excellent resolution during shaping, and thus prevents any play liable to produce vibrations and adversely affect the proper operation of the oscillator.

Moreover, the choice of silicon allows the insertion of etches and decorations in the balance and surface structuring to be carried out.

The setting and adjustment possibilities of this new balance according to the invention mean that any index-assembly can be omitted.

The design of the single piece balance according to the invention allows very precise adjustment of the oscillation frequency of the sprung balance in which it is integrated. The setting and adjustment of the balance are very precise and enable the balance to be used in a high frequency oscillator at 10 Hz or higher.

The objects that the invention set out to achieve are thus perfectly attained.

What is claimed is:

1. A timepiece balance, with inertia adjustment for adjusting the inertia and/or poising and/or oscillation frequency thereof, including a hub arranged for cooperating with an arbour pivoting about a balance staff perpendicular to a balance plane, and a continuous or discontinuous peripheral felloe, connected to said hub by at least one joining surface, wherein said balance has no inserts, and that said felloe is made in a single piece with said joining surface and said hub in a micro-machinable material, or silicon, or quartz, or a compound thereof, or an alloy derived from MEMS technology, or an alloy obtained by the "LIGA" method, and wherein said felloe includes at least a first resilient arm including coupling means arranged for cooperating directly, in various coupling positions, with complementary coupling means comprised in said felloe to form, in a coupling position, a closed loop, the inertia of which relative to said balance staff is variable according to said coupling positions, and wherein said balance is in a single piece with said coupling means and said complementary coupling means.

2. The balance according to claim 1, wherein said first resilient arm includes an elastic connection to said felloe, at least at a first end, and said coupling means at a second end, opposite to said first end.

3. The balance according to claim 1, wherein said complementary coupling means is arranged on a second resilient arm comprised in said felloe.

4. The balance according to claim 3, wherein said second resilient arm includes an elastic connection to said felloe, at least at a first end, and said complementary coupling means at a second end, opposite to said first end.

5. The balance according to claim 4, wherein said second resilient arm also includes at least one elastic connection with said felloe, at a third end distant from said first end and said second end.

6. The balance according to claim 4, wherein said second resilient arm also includes at least one elastic connection with said felloe, at a fourth end distant from said first end and said second end.

7. The balance according to claim 4, wherein said second resilient arm also includes at least one elastic connection with said felloe, at a fifth end, distant from said first end and said second end.

8. The balance according to claim 7, wherein said second resilient arm also includes, at a sixth end, other complementary coupling means arranged for cooperating with coupling means comprised in another first resilient arm, different from that with which said complementary coupling means cooperates.

9. The balance according to claim 1, wherein said coupling means and said complementary coupling means are mobile in relation to each other in a radial direction relative to said balance staff.

10. The balance according to claim 1, wherein said coupling means and said complementary coupling means are mobile in relation to each other in a tangential direction relative to said felloe.

11. The balance according to claim 1, wherein said coupling means and said complementary coupling means are enclosed in said felloe.

12. The balance according to claim 1, wherein said coupling means and said complementary coupling means are formed by antagonistic toothed sectors.

13. The balance according to claim 12, wherein said toothed sectors each include an inclined toothing so as to remain meshed with each other in the absence of any unmeshing action.

14. A sprung balance incorporating at least one balance according to claim 1.

15. A timepiece incorporating at least one balance according to claim 1.

* * * * *